US006112469A

United States Patent [19]

Vuillemot et al.

[11] Patent Number: 6,112,469

[45] Date of Patent: Sep. 5, 2000

[54] SELF-ADHESIVE CORNER SEAL FOR REBATES

[75] Inventors: Valérie Vuillemot, Dijon; Michel Duc, Sixin, both of France

[73] Assignee: Plasto SA, France

[21] Appl. No.: 09/309,058

[22] Filed: May 10, 1999

[51] Int. Cl.[7] ..... E06B 7/22

[52] U.S. Cl. ..... 49/498.1; 49/475.1

[58] Field of Search ..... 49/475.1, 479.1, 49/498.1, 499.1, 493.1

[56] References Cited

U.S. PATENT DOCUMENTS

| | | | |
|---|---|---|---|
| 2,513,789 | 7/1950 | Dudley | 49/475.1 |
| 2,588,628 | 3/1952 | Higbie et al. | 49/475.1 |
| 3,357,137 | 12/1967 | Lombardi et al. | 49/475.1 |
| 3,581,884 | 6/1971 | Caldwell | 49/475.1 X |
| 4,441,755 | 4/1984 | Endo et al. | 49/475.1 X |

FOREIGN PATENT DOCUMENTS

| | | |
|---|---|---|
| 1151433 | 1/1958 | France . |
| 2036840 | 7/1980 | United Kingdom . |

*Primary Examiner*—Jerry Redman
*Attorney, Agent, or Firm*—Ostrolenk, Faber, Gerb & Soffen, LLP

[57] ABSTRACT

A corner seal for rebates includes a base (1) covered on one side (4) with an adhesive, a flexible lip (6) secured to the other side (5) of the base (1). The adhesive is a run (3) of adhesive and the base (1) is equipped with two lateral wings (2*a*, 2*b*) which between them form an angle approximately equal to the angle of the rebate (8).

13 Claims, 2 Drawing Sheets

SELF-ADHESIVE CORNER SEAL FOR REBATES

BACKGROUND OF THE INVENTION

The present invention relates to a novel self-adhesive seal for rebates, which is intended to improve the sealing of doors and windows in buildings, particularly when renovating or improving existing components.

PRIOR ART

Although doors and windows recently manufactured on an industrial scale are increasingly supplied with a flexible seal that provides sealing between the opening leaf and the stationary frame, doors and windows which seal very haphazardly are often encountered in existing buildings. This results in considerable energy loss and discomfort in the dwellings which are ill-equipped in this way.

To overcome these problems, there are seals which can be fitted to the framework to sit between the stationary frame and the opening leaf of the door and thus improve overall sealing; these may be seals obtained by depositing a run of polymerizable mass of the silicone or acrylic type by extrusion from a cartridge, or may be preformed flexible seals such as PVC or polyurethane foams or cellular or compact elastomers which come with various profiles. This last type of seal may be fixed to the stationary frame of the door using staples or, preferably using an adhesive which generally forms an integral part of the marketed seal. As far as the user wishing to perform renovation himself is concerned, flexible elastomer seals equipped with a strip of pressure-sensitive adhesive are fairly easy to fit and do not require significant precautions, unlike seals which are obtained from a cartridge of silicone-based mastic.

Of the known products, mention may also be made of V-shaped seals formed of a strip of metal or plastic bent into a V and fixed to the stationary frame via one of the faces of the dihedran, the other part remaining elastically deformable to press against the door when the door is closed. Like foam or cellular elastomer seals, the V-shaped seals are preferably attached using a pressure-sensitive adhesive.

These various seals do, however, still need to work in compression and cannot withstand shear stresses: it is therefore essential, when fitting the seal to the stationary frame, to ensure that the seal is placed in such a way that the opening leaf will compress the seal on closure and not shear it. In the case of a conventional door hung on hinges, the seals must be fitted as depicted in FIG. 4, that is to say differently, depending on whether it is on the hinge side or on the lock side; it is only if these conditions are satisfied that conventional seals can durably fulfil their function. Now, it is often the case that the user does not take the precaution of following the recommended fitting instructions and that the seal is fitted in the same way all around the door. This generally results in shearing of the seal fitted on the stationary frame bearing the hinges, which then causes the seal to detach, leads to a loss of sealing and finally to user dissatisfaction.

Seals are also known which are used particularly for sealing car doors, and described for example in document GB 2 036 840, said seals having a cylindrical part capable of being crushed between the rebate and the door, this part being connected to a profiled base and equipped on one or both plane faces of the base with an adhesive or magnetic bonding layer: it has, however, been revealed in practice that attachment using just one adhesive-coated face sometimes provides an insufficient bond and that fitting the seal, when both faces are covered with adhesive, is extremely tricky. Furthermore, attachment using magnetic means is not possible when the framework is made of wood or aluminum.

FR 1 151 433 describes a seal, one of the plane faces of which is covered with a layer of adhesive substance and a protector so that it can be fixed to one of the plane parts of the framework; however, it is necessary to take care, at the time of fitting, to place the adhesive face on the face compressed by the seal in order to avoid pulling-off under shear loading.

SUMMARY OF THE INVENTION

The present invention aims to provide a self-adhesive seal for a rebate, that can be used for improving the sealing of doors and openings, and which can be fitted without the risk of error right around the stationary frame of said opening.

According to the invention, there is proposed a flexible self-adhesive seal comprising a base provided with two lateral wings, secured on one face to a flexible lip and covered on the other face with a pressure-sensitive adhesive deposited in the form of a run. The seal is shaped in such a way that the wings adapt to the angle of the rebate or of the framework of the opening.

According to another aspect of the invention, the flexible lip may be a single thickness or, over at least a part, have a hollow cross section.

According to a preferred embodiment, the self-adhesive seal also comprises a removable non-stick temporary protector covering the self-adhesive run.

As mentioned earlier, the object of the invention is to provide a flexible self-adhesive seal designed and shaped to be fixed in the corner of a rebate of the stationary framework that received the door or the window whose sealing is to be improved: such a seal thus exhibits, after fixing, a flexible lip facing roughly along the bisector of the angle of the rebate and can fulfil its function correctly and identically when the leaf of the opening is offered up tangentially to one or other of the two sides of the framework rebate angle.

Other advantages and features of the present invention will emerge better from reading the description of a number of embodiments and from the appended drawings.

DETAILED DESCRIPTION OF THE INVENTION

The self-adhesive seal according to the present invention is intended to be placed in a rebate to fulfil a sealing function, it being possible for the angle of the rebate to vary between certain limits. Ordinarily, the angle of the rebate is a right angle.

Figure 1:
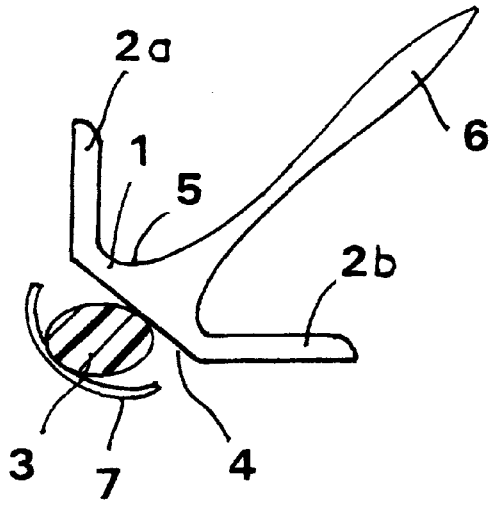
FIG. 1 is a depiction of the self-adhesive seal according to a first embodiment.

The self-adhesive seal according to the invention comprises a base 1 which has two lateral wings 2 which between them form an angle roughly equal to that of the rebate on which said seal is laid. In FIG. 1, the angle of the rebate is 90° and therefore the lateral wings 2*a*, 2*b* are perpendicular to one another to also form an angle of 90°. A run 3 of adhesive is deposited along one side 4 of the base 1 which is secured by its other side 5 to a flexible lip 6 lying roughly in the plane of the bisector of the angle formed by said lateral wings 2*a*, 2*b*. In the examples of the figures, the flexible lip 6 is inclined by about 45° with respect to the lateral wings 2*a*, 2*b*, the base 1 preferably being perpendicular to the flexible lip 6.

Figure 2:
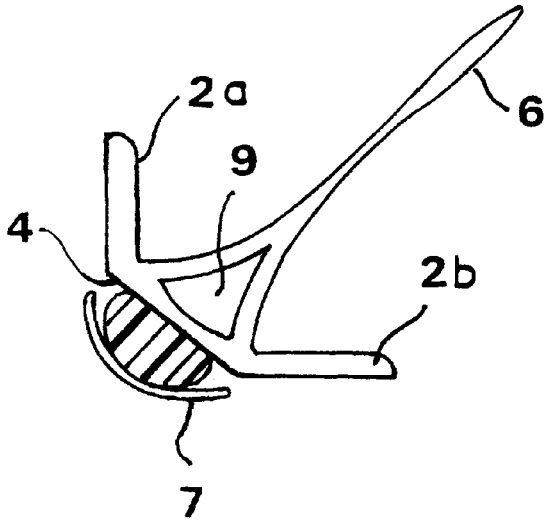
FIG. 2 is a depiction of the self-adhesive seal according to a second embodiment.

The run 3 of adhesive has a cylindrical shape, but could have any other shape such as hemi-cylindrical, as is depicted in FIG. 2, and is covered with a protector 7 that can be removed at the time that the seal is fitted into the receiving rebate 8 (FIG. 3), the protector 7 consisting, for example, of a non-stick film.

In the embodiment depicted in FIG. 1, the flexible lip 6 is solid and constitutes an integral part of the base 1, whereas in the embodiment of FIG. 2, the flexible lip 6 comprises an opening 9 intended to improve the deformation of the lip 6 at the articulation with the base 1.

Figure 3:
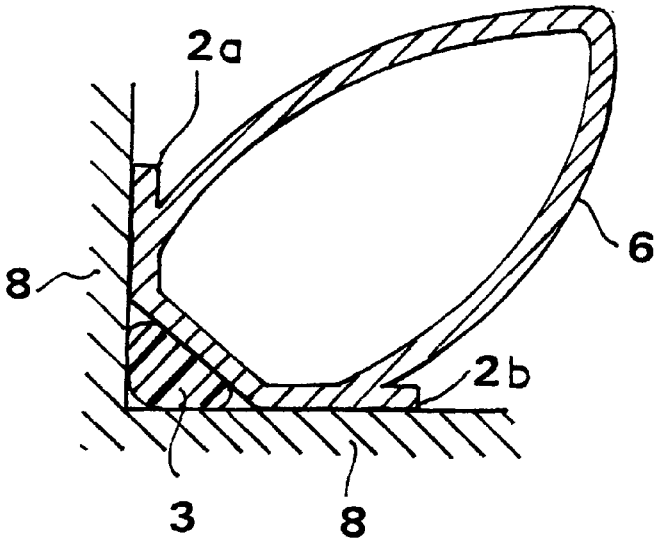
FIG. 3 is a depiction of the self-adhesive seal according to a third embodiment.

According to the embodiment of FIG. 3, the flexible lip 6 is hollow over its entire length and is in the form of a tubular section. Of course, it will be possible to use a flexible lip that is hollow in part and solid along the rest of its length, or alternatively to use other shapes.

Figure 5:
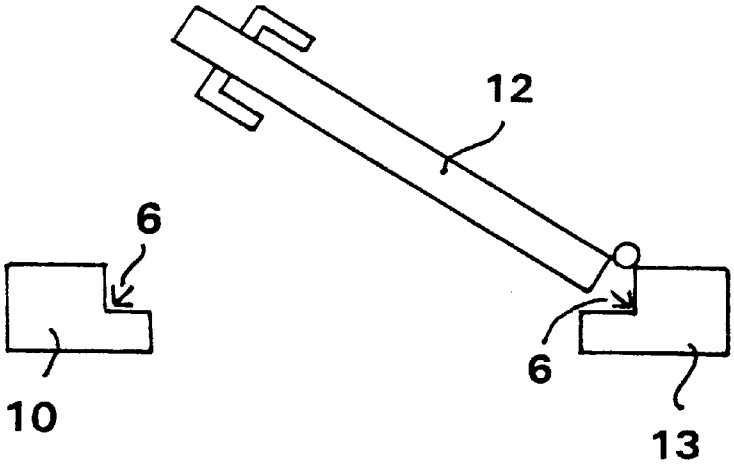
FIG. 5 and 6 are diagrammatic depictions of the use of the self-adhesive seal according to the present invention.

The fitting of the self-adhesive seal according to the present invention is depicted diagrammatically in FIG. 5.

Figure 4:
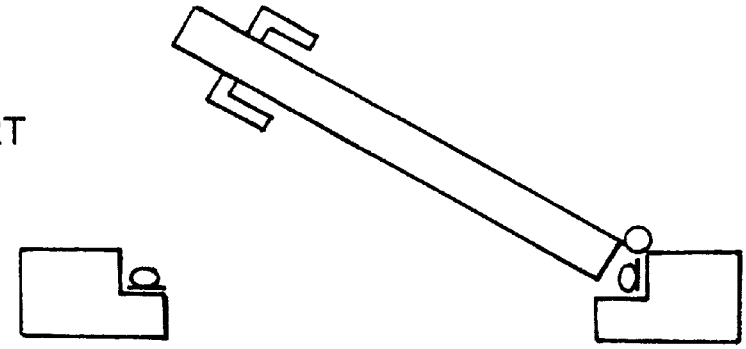
FIG. 4 PRIOR ART
FIG. 4 is a diagrammatic depiction of a seal according to the prior art and of the positioning on a framework.

The seal of the prior art depicted in FIG. 4 has to be fitted differently depending on whether it is on the upright that carries the leaves of the hinges or on the upright on the lock side. If these fitting instructions are not followed, the seal is subjected to lateral stresses which cause it to detach or to be cut. By contrast, the seal according to the present invention is fitted in the same way regardless of which part of the framework is receiving the seal, which makes fitting easier and eliminates the risk of error. When the seal is fitted in the rebate of the stationary frame 10 receiving the end 11 of a leaf 12, the flexible lip 6 is bent downward, whereas on the side 13 of the hinges 14, the flexible lip 6 is bent upward. Thus there is no shearing of the seal and the risk of damage is therefore eliminated.

The particular profile of the base of the seal according to the invention makes it possible simultaneously to obtain easy fitting of the seal with a self-centering effect and good orientation of the flexible lip: according to FIG. 1, the wings 2*a* and 2*b* of the base, which wings are not coated with adhesive, have the function of guiding the seal right into the angle of the framework and then of keeping the flexible lip 6 in the position of the bisector of the angle of the rebate, that is to say, in general, at an angle of 45° with respect to each of the faces of the rebate once the run of adhesive has bonded the seal to the rebate.

Practical production of the seal calls upon known techniques and materials; the seal is preferably obtained by extrusion using a thermoplastic and/or rubbery material such as, for example, synthetic rubbers based on EPDM, possibly formulated with polypropylene, or based on silicone elastomers, or alternatively based on SIS, SBS or SEBS triblocks. Any type of flexible and elastic, compact or cellular, material may be used.

The run 3 of adhesive may be deposited directly onto the base of the seal or, depending on the elastomer used, after coating with a primer which improves the bond between the elastomer and the adhesive mass.

The run 3 of pressure-sensitive adhesive may for example be based on a hot melt formulation comprising elastomers of the triblock type such as SIS, SBS or SEBS, associated with tackifying resins such as terpene-type resins or colophane resins. Use may also be made of other self-adhesive formulations, for example ones based on butyl rubber, preferably choosing cohesive and shapable adhesive masses. The runs of adhesive are generally obtained by hot extrusion of the blended mass and may be extruded as a compact or blown with nitrogen. The run 3 of adhesive deposited on the base may have a cylindrical cross section (as depicted in FIG. 1) or a cross section in the form of a hemi-cylinder with, in this case, the flat face pressing against the base, as depicted in FIG. 2.

The temporary protective film may be made of waxed paper or may be a non-stick polyethylene or polyester film.

EXAMPLE

A seal, the shape of the cross section of which is depicted in FIG. 3, is hot-extruded from a mass of thermoplastic elastomers based on EPDM and polypropylene (marketed under the trade name SANTOPRENE) to obtain a continuous seal, whose height between the base and the free end of the lip is about 11 mm.

A run of adhesive mass based on butyl rubber is then deposited on the central face of the base (the diameter of the run is approximately 2 mm) and this run of adhesive is covered with a waxed paper protector about 4 mm wide.

Figure 6:
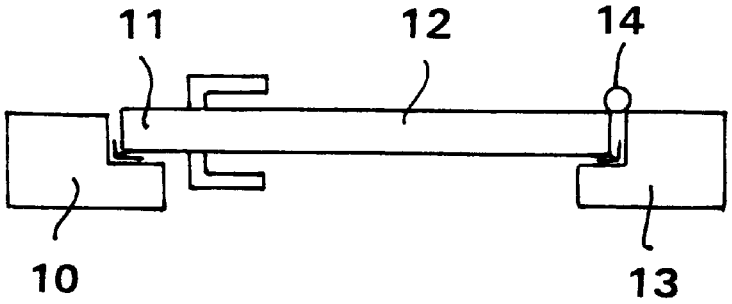

Such a seal is well suited to sealing doors or windows in which the space to be filled between the stationary frame and the opening leaf may vary between 2 and 8 mm; the seal must be laid in the angle of the rebate in the framework, the two wings 2*a* and 2*b* of the base each pressing on one of the faces of the rebate. This specific shape of the base allows the run of adhesive to nest perfectly in the angle of the rebate and to obtain a perfectly centered position of the seal. FIG. 6 depicts the flexing of the seal as the opening leaf is closed, this flexing occurring on either side of the bisecting plane, depending on which side of the stationary frame the seal is fitted.

Thus, although it has been fitted in the same way around the entire perimeter of the stationary frame, the seal fulfills its function correctly and durably by adapting its deformation on each of the sides of the opening.

The example described above is particularly well suited to door and window renovation work in dwellings. It is also possible, without departing from the field of the invention, to produce self-adhesive seals suited to openings of different sizes or for spheres of activity other than the building trade.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A self-adhesive seal for a rebate, wherein the rebate has two surfaces forming a first angle, the seal comprising:

a base having a first side and a second side, the first side facing toward the first angle between the surfaces so as to form a triangle with the first angle, and the second side being opposite the first side and facing away from the first angle;

a pair of lateral wings extending from the base and being oriented so that between them they form a second angle approximately equal to the first angle of the rebate;

a run of adhesive which covers the base first side but not the pair of lateral wings; and a flexible lip secured to and extending out from the second side of the base.

2. The seal of claim 1, wherein the flexible lip extends away from the base of the seal approximately in a plane bisecting the second angle formed by the lateral wings of the seal.

3. The seal of claim 2, wherein the lateral wings define the second angle as a right angle.

4. The seal of claim 2, wherein the flexible lip has a hollow cross-section.

5. The seal of claim 1, wherein the lateral wings define the second angle as a right angle.

6. The seal of claim 1, wherein the flexible lip has a tubular cross sectional shape for at least a part of the length of the seal.

7. The seal of claim 1, further comprising a removable protective film over the run of adhesive.

8. The seal of claim 7, wherein the run of adhesive is approximately cylindrical in cross section.

9. The seal of claim 7, wherein the run of adhesive is approximately semi-cylindrical in cross section.

10. The seal of claim 1, wherein the run of adhesive is approximately cylindrical in cross section.

11. The seal of claim 1, wherein the run of adhesive is approximately semi-cylindrical in cross section.

12. The seal of claim 1, used for improving the sealing of openings in a building.

13. The seal of claim 1, wherein the flexible lip has a hollow cross-section.

* * * * *